US006042510A

United States Patent [19]

Miller

[11] Patent Number: 6,042,510

[45] Date of Patent: Mar. 28, 2000

[54] JUMPING JACK EXERCISE DEVICE

[76] Inventor: Larry Miller, 4030 Oak Tree Cir., Rochester, Mich. 48306

[21] Appl. No.: 08/958,590

[22] Filed: Oct. 29, 1997

[51] Int. Cl.[7] ..... A63B 22/04

[52] U.S. Cl. ..... 482/51; 482/52

[58] Field of Search ..... 482/51, 70, 71, 482/907, 96; 472/15, 52

[56] References Cited

U.S. PATENT DOCUMENTS

| | | | |
|---|---|---|---|
| 4,506,884 | 3/1985 | Hankin | 482/71 |
| 4,529,192 | 7/1985 | Stites . | |
| 4,776,581 | 10/1988 | Shepherdson . | |
| 4,850,585 | 7/1989 | Dalebout | 482/51 |
| 4,861,023 | 8/1989 | Wedman | 482/51 |
| 5,178,599 | 1/1993 | Scott . | |
| 5,209,711 | 5/1993 | Scrima | 482/70 |
| 5,279,532 | 1/1994 | Chen | 482/71 |
| 5,328,427 | 7/1994 | Sleamaker | 482/71 |
| 5,419,747 | 5/1995 | Piaget | 482/51 |
| 5,496,239 | 3/1996 | Kallman | 482/71 |
| 5,520,598 | 5/1996 | Little | 482/51 X |
| 5,536,224 | 7/1996 | Hsieh . | |
| 5,536,225 | 7/1996 | Neuberg et al. . | |
| 5,584,781 | 12/1996 | Chen | 482/51 |
| 5,603,675 | 2/1997 | Wu | 482/51 |
| 5,605,521 | 2/1997 | Hsieh | 482/51 |
| 5,741,204 | 4/1998 | Lee | 482/51 |
| 5,792,027 | 8/1998 | Gvoich | 482/51 |

OTHER PUBLICATIONS

"Stepswing ™ The Lateral and Vertical Exercise Trainer," Ben J. McCullom (Undated brochure).

*Primary Examiner*—Richard J. Apley
*Assistant Examiner*—William LaMarca
*Attorney, Agent, or Firm*—Gifford, Krass, Groh, Sprinkle, Anderson & Citkowski, P.C.

[57] ABSTRACT

A jumping jack exercise device that includes a frame configured to be supported on a floor. A first and second leg link, each including a foot support, pivotally supported by the frame for motion in a straddle plane which extends to the sides of a user whose feet are engaged by the foot supports. The exercise device also includes two arm links, which allow for motion in the straddle plane. The device permits a user to perform a jumping jack exercise under low impact conditions.

3 Claims, 3 Drawing Sheets

JUMPING JACK EXERCISE DEVICE

FIELD OF THE INVENTION

This invention relates generally to exercise equipment. More specifically, the invention relates to an exercise device which allows a user to carry out a jumping jack exercise in which inward and outward motions of the legs take place simultaneously with upward and downward motions of the arms, in a straddle plane.

BACKGROUND OF THE INVENTION

There is a steadily growing appreciation for the benefits of regular exercise, and many persons incorporate a range of different exercises into their exercise programs. Jumping jacks are a widely used form of exercise. The exercise begins with a person standing, feet together and arms at their side. In the first stage of the exercise, a person jumps upward while pivoting their legs out to the sides and simultaneously swinging their straightened arms to an overhead position. The second phase of the exercise begins with a person's legs on the floor in a straddle position, and their arms straight overhead. The person again jumps upward while pivoting the legs back to a closed position and swinging the straightened arms to a lowered position. In the jumping jack exercise, the arms and legs move in the straddle plane, and within the context of this disclosure, a straddle plane is defined as a plane passing generally through a person's spine and shoulders, and extending generally laterally from the person's body. Motion of a person's arms and legs, when carrying out a jumping jack exercise, is to be contrasted with motion of their arms and legs during walking, running and striding exercises in which such motion occurs generally perpendicular to the straddle plane.

Jumping jack exercises provide good aerobic conditioning and exercise a large number of muscles. Since jumping jack exercises take place primarily in the straddle plane, they provide a range of motion not generally achievable with other exercises and hence are a good adjunct to stepping, striding, and running exercises. However, jumping jack exercises are jarring to the spine, knees, and ankles and hence can produce or aggravate joint damage. These problems have limited the use of jumping jack exercises in many training programs.

Accordingly, it will be appreciated that there is a need for an exercise apparatus which provides the benefits of exercise in the straddle plane, while minimizing the jarring impacts associated with traditional jumping jack exercises. The prior art does not disclose or suggest any apparatus which allow jumping jack exercises to be carried out under low impact conditions. U.S. Pat. No. 5,536,225 shows a skiing simulator which allows for combined side to side and vertical movement of a user's legs in a manner corresponding to those encountered in downhill skiing. However, the device disclosed in this patent does not provide for any pivoting motion of the user's arms and does not permit simultaneous, outward leg pivoting and arm pivoting in the straddle plane as is achieved in jumping jack exercises. U.S. Pat. No. 5,536,224 discloses a striding exercise apparatus which allows for the motion of a user's arms and legs in a plane generally perpendicular to the straddle plane so as to simulate walking. Again, this apparatus cannot be employed to carry out jumping jack exercises. Accordingly, it should be appreciated that the prior art does not show or suggest any exercise apparatus which allows for the low impact, simultaneous pivoting motion of a user's arms and legs in the straddle plane. As will be explained in detail herein below, the present invention is directed to an exercise apparatus which supports a user in a spaced apart relationship with the floor, so as to permit the user to carry out jumping jack exercises under low impact conditions. These and other advantages of the present invention will be apparent from the drawings, discussion, and description which follow.

BRIEF DESCRIPTION OF THE INVENTION

Disclosed herein is a jumping jack exercise device which includes a frame configured to be supported on a floor. A first and a second leg link are supported by the frame so as to be pivotable in the straddle plane. The leg links each include a foot support configured to engage the foot of a user. The device further includes a first and a second arm link, each of which includes a hand grip portion. Each of the arm links is capable of pivoting in the straddle plane. In use, the exercise device supports a user in a spaced apart relationship with the floor while permitting the user to simultaneously move his or her arms and legs in the straddle plane.

In specific embodiments, the arm links are each mechanically coupled to a respective one of said foot links so as to move in unison therewith. Such mechanical coupling may be achieved through the use of a chain, belt, cable, or elastic band. The arm links may be rigid, hinged, or resilient. The device may further include a flywheel coupled to the links for increasing their inertia, and hence the smoothness of the motion of the apparatus. The exercise device may also include a variable resistance means such as a friction brake or electromagnetic brake varying the workload on the device.

DETAILED DESCRIPTION OF THE INVENTION

The present invention comprises an exercise device which supports a person above the surface of a floor and which permits simultaneous, lateral motion of both of the person's arms and legs, in a straddle plane so as to permit them to carry out a jumping jack exercise. As will be appreciated from the drawings and descriptions herein below, there are a number of different embodiments of an exercise device which may be configured in accord with the present invention. Illustrated herein are some specific embodiments.

Figure 1:
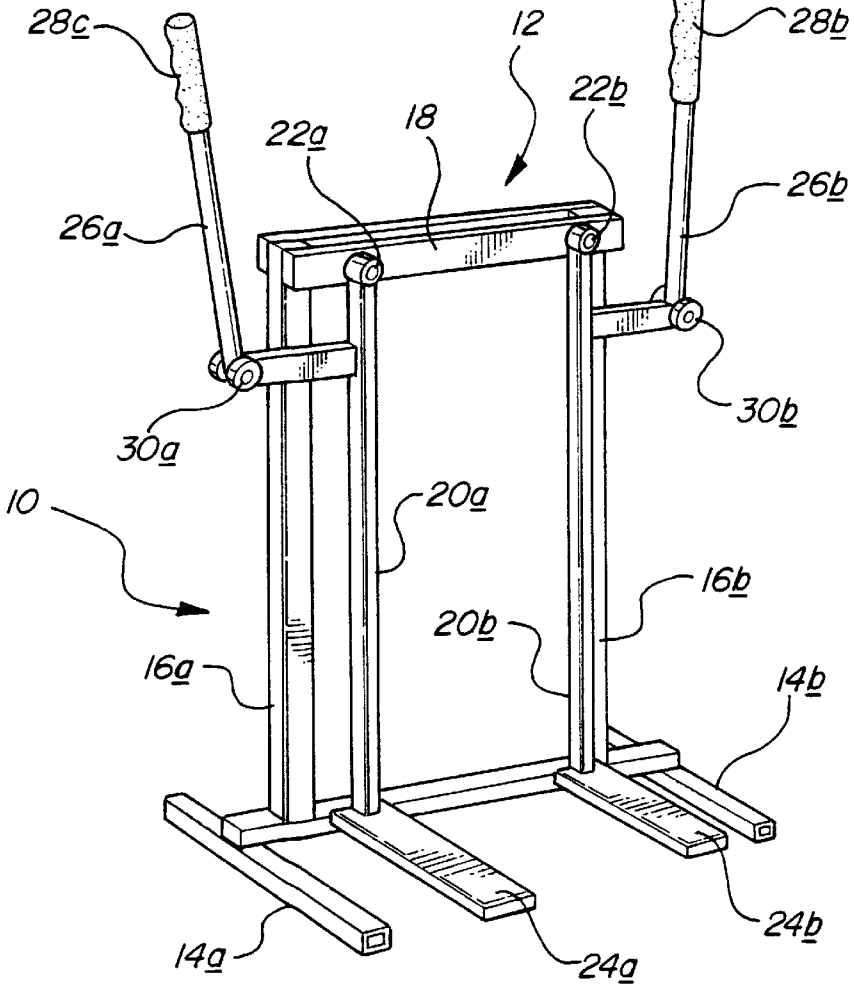
FIG. 1 is a perspective view of one embodiment of the exercise device structured in accord with the principles of the present invention.

In FIG. 1, there is shown a first embodiment of an exercise device 10 in accord with the present invention. The device 10 includes a frame 12 configured to be supported on a floor and toward this end includes a pair of feet 14*a*, 14*b* for contacting the floor, a pair of uprights 16*a*, 16*b* extending upwardly from the feet 14, and a cross bar assembly 18 supported by the uprights 16. A first leg link 20*a* and a second leg link 20*b* are supported on the crossbar 18 by pivotal connections 22*a*, 22*b* which allow the leg links 20 to pivot in the straddle plane. Each of the leg links 20*a*, 20*b* extends downwardly from the pivotal connections 22*a*, 22*b* and each leg link 20*a*, 20*b* further includes a foot support 24*a*, 24*b* at the bottom end thereof. The foot supports 24 may also include clamps, straps or the like for returning a user's foot.

The device 10 of FIG. 1 further includes a first arm link 26*a* and a second arm link 26*b*, and each arm link 26*a*, 26*b* is connected to a respective one of the leg links 20*a*, 20*b*. It will further be noted that the arm links 26 each include a hand grip portion 28*a*, 28*b* at the free end thereof. Also, in the illustrated embodiment, each arm link 26 includes a hinge 30*a*, 30*b* at a point between its free end and its fixed end. The arm links 26, like the leg links 20, allow movement in the straddle plane.

In order to carry out a jumping jack exercise, a user places one foot on each of the foot supports 24 and grasps the hand portions 28 of the arm links 26 with their hands. Most preferably, the user will be facing toward the cross bar assembly 18. In the start position, the user's legs will be approximately perpendicular to the floor, and the user's arms will be generally vertical. The hinges 30 in the arm links 26 facilitate positioning of the user's arms. To begin the exercise, the user will swing his or her legs outward in the straddle plane, which corresponds generally to the length of the cross bar assembly 18, thereby pivoting the leg links 20 and causing an upward motion of the arm links 26. Likewise, by asserting an upward force on the arm links 26, the user may assist the outward motion of the legs. Unlike in traditional jumping jacks, it is not necessary for the user to jump up in order to move their legs and arms in the straddle plane. By eliminating the need to jump up, the device 10 minimizes the shock associated with traditional jumping jack exercises. The exercise cycle is completed by returning the arms and legs back to the vertical start position. Impact with the floor is eliminated, again minimizing shock to the users joints. The cycle is then repeated as many times as is desired. It will thus be seen that the device 10 of FIG. 1 provides for a smooth jumping jack motion while moderating impact and shock to the user's joints.

Numerous modification and variations of the FIG. 1 device may be implemented in accord with the present invention. For example, the hinges 30 may be eliminated from the arm links 26. In other variations, the arm links 26 may be fabricated from a resilient material such as a body of fiber reinforced polymer. Such resilient arm links provide some flexibility to accommodate forward arm motion. In other embodiments, the leg links 20 are adjustable so that the device can comfortably accommodate users of different heights. The leg links 20 are adjusted in several ways; by varying the length of the links 20 themselves, by adjusting the point at which the foot supports 24 are affixed to the links 20, and/or by adjusting the point at which the leg links 20 are connected to the support frame 12. Also, it is to be understood that while the support frame 12 is shown as including two uprights 16 and a crossbar 18, a variety of other frame arrangements may be implemented in accord with the teaching herein. For example, the frame 12 may include a single support pillar which directly supports both leg links 20, in which instance each leg link 20 will include a bent portion so as to permit the foot supports 24 to be supported in a spaced apart relationship. Alternatively, a single support pillar can be used in conjunction with a crossbar 18 to provide a spaced apart support for the leg links 20.

Figure 2:
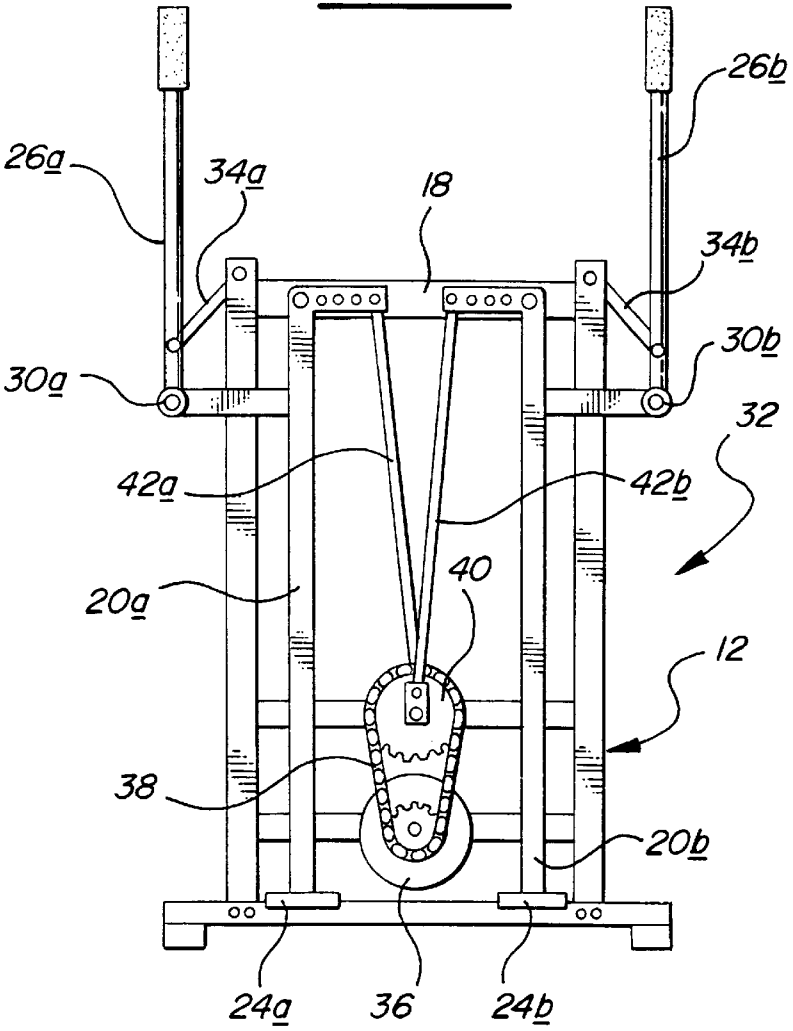
FIG. 2 is a front, elevational view of another embodiment of the exercise device of the present invention.

FIG. 2 illustrates another embodiment of an exercise device 32 in accord with the principles of the present invention. Device 32 includes a frame 12 which is generally similar to the frame 12 previously described. A first leg link 20*a* and a second leg link 20*b* are pivotally supported on a cross bar 18 of the frame 12, and, as in the previous embodiment, each leg link 20 includes a foot support 24. The device 32 includes arm links 26*a*, 26*b* which are joined to respective leg links 20*a*, 20*b* as in the previous embodiment. The arm links 26 include hinges 30 therein and each of the arm links 26 also includes an auxiliary link 34*a*, 34*b* which joins the respective arm link 26 to the frame 12. These auxiliary links 34 function to further control the path of travel of the arm links 26 as they move in the straddle plane together with the leg links 20. In the embodiment illustrated in FIG. 2, the auxiliary links 34 are shown as each having single connection points attaching them to the arm links 26 and the frame 12. However, it is to be understood that the connection points for the auxiliary links 34 may be made adjustable to accommodate different users and different desired motions.

The FIG. 2 embodiment further includes a flywheel 36 which is mechanically connected to the leg links 24 by means of a drive chain 38 which engages a crank wheel 40, which in turn is connected to the leg links 24 by crank rods 42*a*, 42*b* as illustrated. This connection may also be made adjustable. The flywheel 36 adds inertia to the mechanical system thereby smoothing out the motion of the arm and leg links. As is known in the art, an electromagnetic brake, friction brake, or pneumatic or hydraulic device may be associated with the flywheel, or some other portion of the mechanical linkage, for varying the amount of force needed for pivoting the leg links 20 in the straddle plane of the apparatus.

Figure 3:
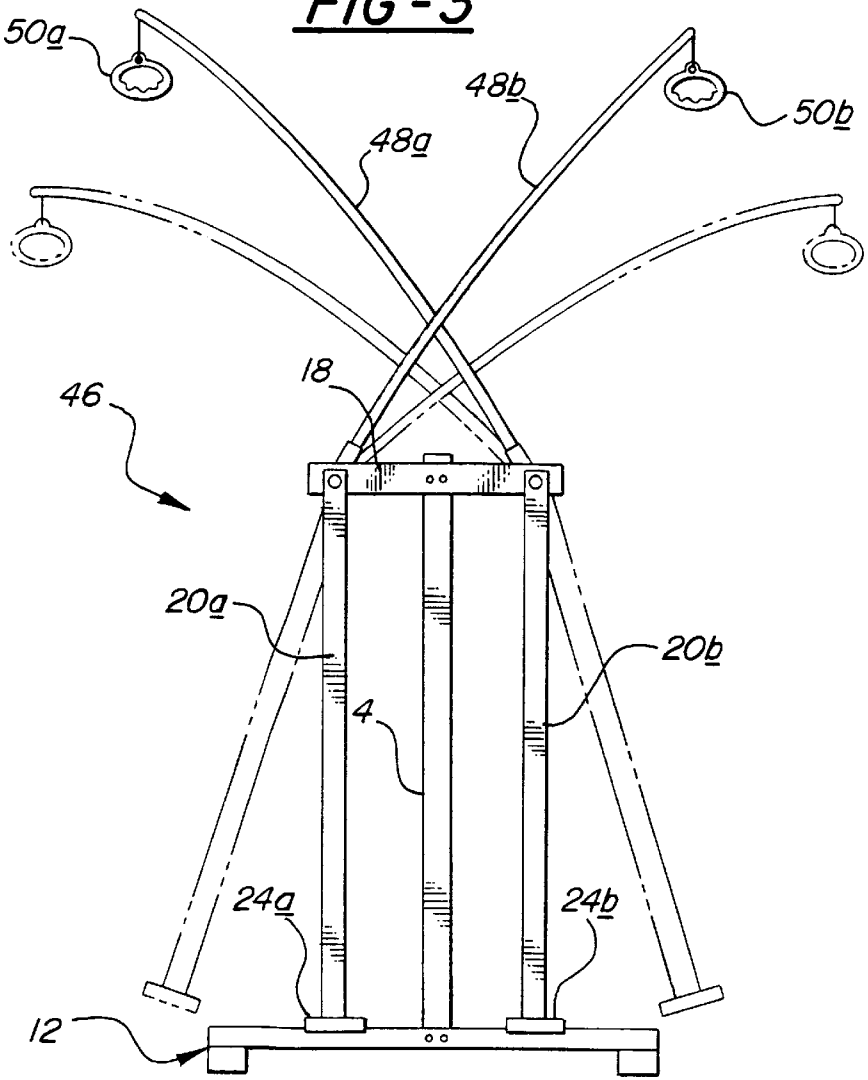
FIG. 3 is a front, elevational view of another embodiment of the exercise device of the present invention.

FIG. 3 illustrates yet another version of the jumping jack exercise device of the present invention. The FIG. 3 embodiment 46 includes a frame 12 having a single, central upright 47 which supports a cross bar 18. As in the previous embodiments, leg links 20, having foot supports 24, are pivotally supported on the cross bar 18 for motion in the straddle plane. In the FIG. 3 embodiment, the arm links 48*a*, 48*b* are comprised of flexible, resilient rods, preferably made from glass or graphite reinforced polymeric resin, and include hand grip loops 50*a*, 50*b* dependant therefrom. In the simplest version of the FIG. 3 embodiment, the flexible arm links 48 are not mechanically coupled to the leg links 20, but are supported by the crossbar 18 of the frame 12. To use this embodiment, first the arm links 48 are grasped by the hand grip loops 50 and flexed downward to the starting position as indicated by the phantom outlines. In the first stage of the jumping jack exercise, the leg links 20 are pivoted outward along the straddle plane to an extended position as shown by the phantom outline. In unison therewith, arm links 48 are bent back to the original upward position. Completion of the exercise cycle involves biasing the flexible arms links 48 back to the starting position shown by the phantom outline, while returning the leg links 20 to the vertical position.

In other versions of the FIG. 3 device 46, the flexible arm links 48 are mechanically coupled to the leg links 20. The right hand arm link 48*b* is coupled to the left hand leg link 20*a* and the left hand arm link 48*a* is coupled to the right hand leg link 20*b*. Consequently, downward movement of the right hand arm link 48*b* tends to bias the left hand leg link 20*a* away from the vertical position. In an embodiment of this type, biasing the flexible arm links 48 to the start position stores mechanical energy therein. This energy assists in the beginning of the exercise cycle by tending to bias the leg links 20 outwardly to their extended positions. In some embodiments of the FIG. 3 device, the flexible arm links 48 are curved so that they need not be biased into a start position.

Figure 4:
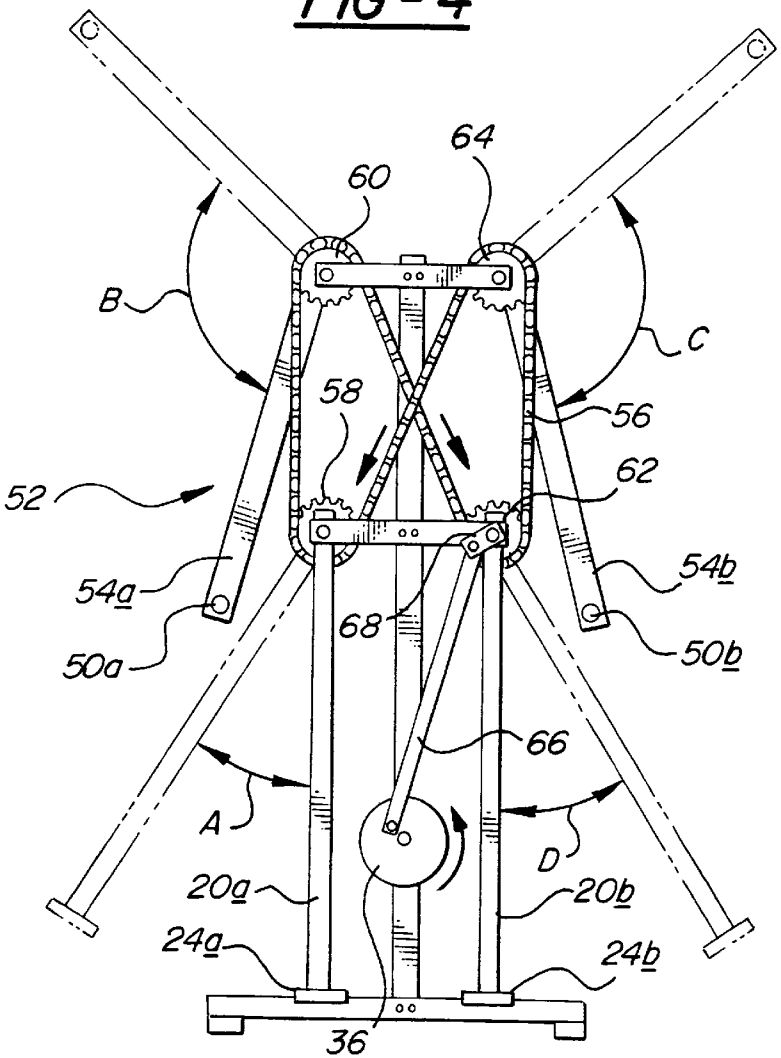
FIG. 4 is a schematic depiction of a portion of another embodiment of the exercise device structured in accord with the principles of the present invention.

FIG. 4 is a schematic depiction of yet another embodiment of the present invention. For clarity of illustration of the mechanical components, the support frame has been eliminated from the FIG. 4 illustration, but it is to be understood that an appropriately configured support frame will be readily apparent to those of skill in the art. In FIG. 4, an exercise apparatus 52 includes leg links 20 having associated foot supports 24 as previously described. The device 52 also includes arm links 54*a*, 54*b*, which, as illustrated, are relatively rigid members having hand grips 50*a*, 50*b* at one end thereof. In the illustrated embodiment, a drive chain and sprocket linkages connect the leg links 20*a*, 20*b* and arm links 54*a*, 54*b* all together so that they move in unison. The linkage includes a drive chain 56 which passes in turn over a first sprocket 58 associated with the first leg link 20*a*, a second sprocket 60 associated with the first arm link 54*a*, a third sprocket 62 associated with the second leg link 20*b*, and a fourth sprocket 64 associated with the second arm link 54*b*. This causes the entire linkage to move in unison in the straddle plane, as indicated by arrows A, B, C, and D. Alternatively, a flexible belt could be substituted for the drive chain 56.

As further shown in the FIG. 4 embodiment, a flywheel 36 is in mechanical communication with the linkage by a crank rod 66 joined to the third sprocket 62 by means of a crank arm 68. Obviously, connection to the linkage may be made through other members in a like manner.

Figure 5:
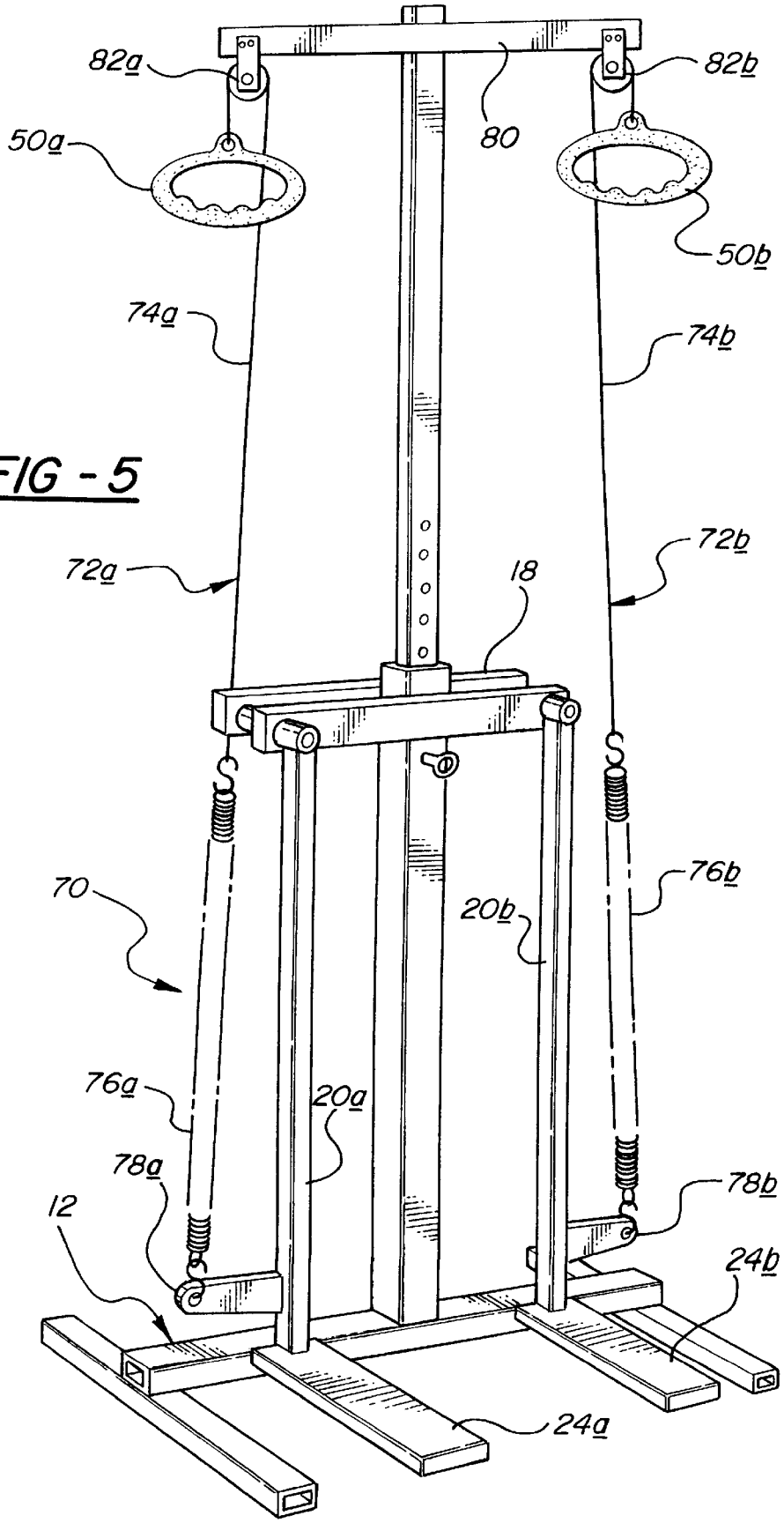
FIG. 5 is a perspective view of another embodiment of the exercise device of the present invention.

FIG. 5 illustrates yet another embodiment of an exercise device 70 structured in accord with the principles of the present invention. The FIG. 5 embodiment includes a frame 12 generally similar to that previously described and further includes leg links 20 pivotably supported upon a crossbar assembly 18 thereof and including foot supports 24. In the FIG. 5 embodiment, the arm links 72*a*, 72*b* each comprise a cable 74*a*, 74*b* which is connected to a resilient body 76*a*, 76*b* made of a spring or of an elastomeric material such as rubber, which in turn is connected to a respective leg link 20*a*, 20*b* through attachment tabs 78*a*, 78*b*. The cables 74*a*, 74*b* include hand grips 50*a*, 50*b*, and are supported on the frame by pulleys 82*a*, 82*b* which are in turn supported by a cross bar 80. Exercise device 70, like the previous embodiments, allows a user to simultaneously move his or her arms and legs in the straddle plane. To that end, it will be understood that as the legs are pivoted outward the arms will be raised upward. Extension of the resilient bodies 76 in the arm links 72 prevents shocks from being communicated between the arms and legs, and provides for some storage of kinetic energy, which energy may be transferred back and forth between the arms and legs. The height of the crossbar 80 supporting the arm links 72 is adjustable to accommodate users of different heights.

Other embodiments of the present invention may implemented in accord with the teaching herein. For example, all embodiments have shown foot supports as comprising platforms which are stood upon by a user. It is also possible that the foot supports may comprise loops or stirrups which receive a user's foot. Also, in some instances, an electric motor or other mechanical drive may be incorporated into the invention to assist in the motion of the various linkages. Other devices such as speed indicators, time indicators, ergometers or the like may also be incorporated into the apparatus. In view thereof, it will be understood that numerous modifications and variations of the present invention may be implemented by one of skill in the art in view of the teaching presented herein. The foregoing drawings, discussion and description are illustrative of particular embodiments of the present invention, but are not meant to be limitation upon the practice thereof. It is the following claims, including all equivalents, which define the scope of the invention.

What is claimed is:

1. A jumping jack exercise device comprising:

a frame configured to be supported on a floor;

a first leg link and a second leg link, each leg link including a foot support configured to engage a foot of a user, each leg link being supported by said frame so as to be pivotable in a straddle plane which extends to the sides of a user whose feet are engaged by said foot supports;

a first arm link which includes a hand grip and which is mechanically coupled to said first leg link so as to move in said straddle plane, in simultaneous unison with said first leg link;

a second arm link which includes a hand grip and which is mechanically coupled to said second leg link so as to move in said straddle plane, in simultaneous unison with said second leg link; and said first and second arm link being coupled to the first and second leg links respectively by coupling means which provide the capacity for movement of said arm links in either the same or opposite lateral direction in the same lateral plane.

2. An exercise device as in claim 1, wherein said arm links comprise rigid members.

3. An exercise device as in claim 1, wherein said arm links comprise hinged members.

* * * * *